United States Patent [19]

Ikeda

[11] Patent Number: 4,689,613

[45] Date of Patent: Aug. 25, 1987

[54] CHARACTER AND PATTERN DISPLAY SYSTEM

[75] Inventor: Tetsuya Ikeda, Yokohama, Japan

[73] Assignee: Hitachi, Ltd., Tokyo, Japan

[21] Appl. No.: 741,106

[22] Filed: Jun. 4, 1985

[30] Foreign Application Priority Data

Jun. 6, 1984 [JP] Japan ..... 59-114537

[51] Int. Cl.[4] ..... G09G 1/28

[52] U.S. Cl. ..... 340/703; 340/701; 340/744; 340/804

[58] Field of Search ..... 340/701, 703, 744, 747, 340/748, 750, 789, 803, 804

[56] References Cited

U.S. PATENT DOCUMENTS 4,016,544 4/1977 Morita et al. ..... 340/703

4,303,986 12/1981 Lans ..... 340/703

4,514,818 4/1985 Walker ..... 340/703

*Primary Examiner*—Gerald L. Brigance

*Assistant Examiner*—Jeffery A. Brier

*Attorney, Agent, or Firm*—Antonelli, Terry & Wands

[57] ABSTRACT

A character and pattern display system having display memories composed of memory planes for storing red, green and blue data, comprises a color data register in which foreground color and background color data are set, and a pattern data select and control circuit which, in response to an output from the color data register, converts pattern data into data to be written into the memory planes.

In writing character and pattern data of designated foreground colors and background colors into the memory planes of red green and blue, the processing is raised in speed.

6 Claims, 5 Drawing Figures

CHARACTER AND PATTERN DISPLAY SYSTEM

The present invention relates to character and pattern display systems, and more particularly to a character and pattern display system which is suited to facilitate reception and display processing in a character and pattern information system, such as teletext or videotex.

In a display circuit which displays characters and patterns and which is used in, for example a personal computer, a high-speed writing system which includes display memories of dot-by-dot coloring composed of three memory devices for displaying the three primary colors of red, green and blue, respectively, and in which the respective display memories are provided with color data registers so as to simultaneously write data into the plurality of display memories is disclosed in the official gazette of Japanese Patent Application Laid-Open No. 187996/1983 (corresponding to European Patent Application Publication No. 0093954).

However, in a case where the personal computer having the display circuit of such a high-speed writing system is used as the terminal of, for example, a videotex with the intention of performing data display, the process of writing data into the display memories becomes complicated as compared with the processing of the display circuit of a terminal for exclusive use comprising a pattern data memory and a color data memory, because character and pattern data are composed of parts concerning pattern data and parts of color data which consist of foreground color designation for coloring dots having the pattern data of "1" and background color designation for coloring dots having the pattern data of "0". More specifically, with the prior-art display circuit, on account of a memory plane arrangement for each of the three primary colors of red, green and blue, the writing of the character and pattern data composed of the pattern data and the color data requires the two display processing operations of the first writing of foreground color data in which the color data of foreground colors are written into the color data registers, whereupon the pattern data are written into the display memories, and the second writing of background color data in which the contents of the color data registers are rewritten into the color data of background colors, whereupon inverted pattern data obtained by inverting the pattern data are written into the display memories in superimposed fashion. This has led to the problem that a long time is needed for the display processing, so the display speed becomes lower than in the direct writing processing of a display memory arrangement made up of the pattern data memory and the color data memory as in the exclusive terminal.

An object of the present invention is to solve the problem of the prior art described above, and to provide a character and pattern display system which can raise the speed of the writing processing of character and pattern data composed of pattern data and color data.

In order to accomplish such object, according to the present invention, a character and pattern display system having a plurality of display memories, display memory reading means to read out character and pattern data written in the display memories, and picture signal conversion means to convert the read-out data into picture signals; comprises color data recording and holding means to record and hold a plurality of sorts of color data of characters and patterns; a plurality of decode circuits which are disposed in correspondence with the respective display memories and which generate control signals corresponding to said display memories respectively on the basis of the plurality of sorts of color data stored in said color data recording and holding means; and a plurality of pattern data conversion circuits which, in response to the control signals delivered from the corresponding decode circuits, convert pattern data of the characters and patterns into data corresponding to said display memories respectively and write the converted pattern data into the corresponding display memories respectively.

According to the present invention, even in display memories of an arrangement of planes expressive of different colors such as red, green and blue unlike display memories of an arrangement composed of the pattern data memory and the color data memory, character and pattern data having foreground colors and background colors designated can be simultaneously converted into data to be written into the display memories of the respective planes, merely by the setting of the color data in the color data recording and holding means and the processing of writing the pattern data, so that enhancement in the speed of the writing into the display memories can be realized.

Figure 1:
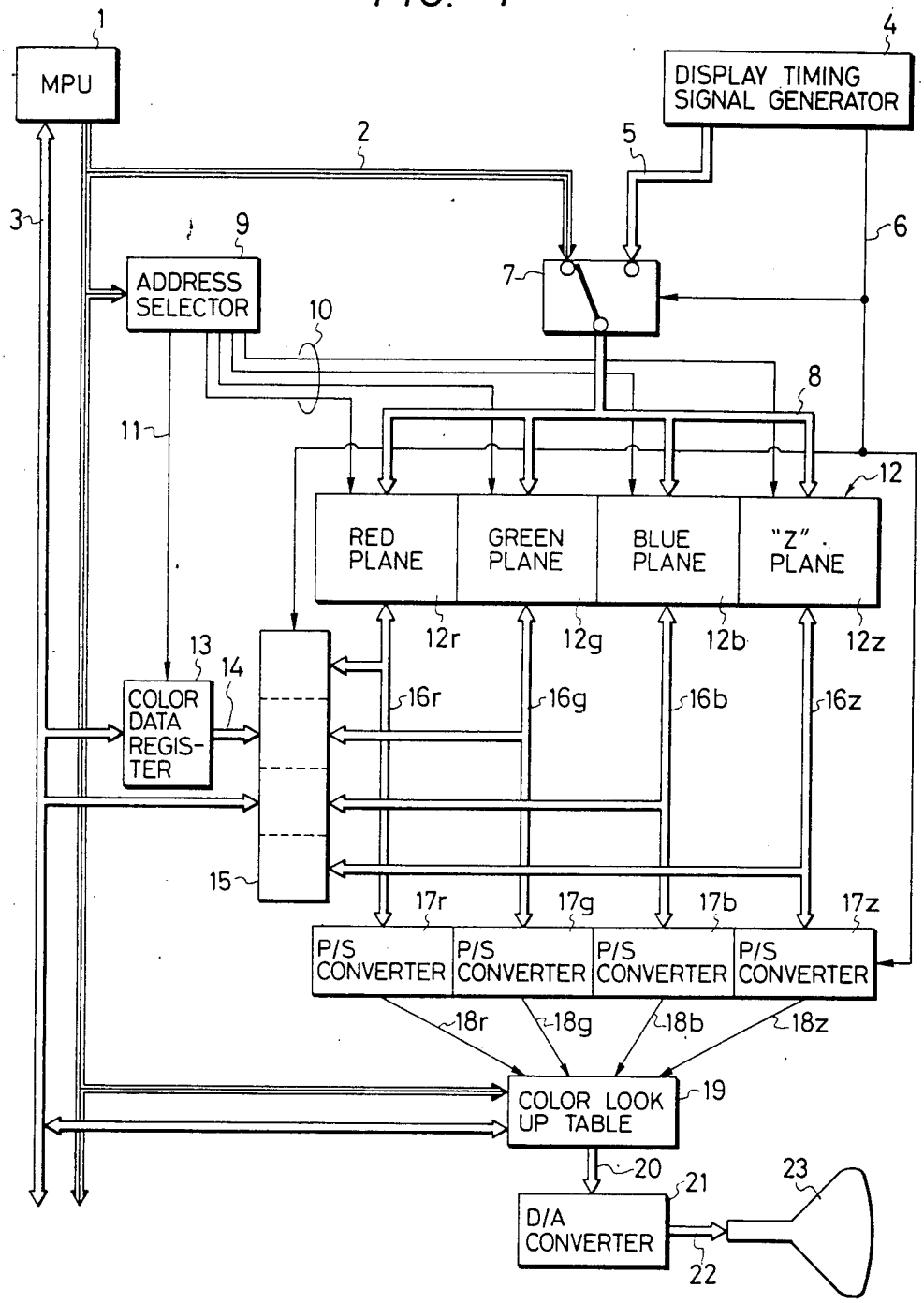
FIG. 1 is a block diagram showing an embodiment of a character and pattern display system according to the present invention.

Now, an embodiment of the present invention will be described in detail. FIG. 1 is a block diagram showing one embodiment of a character and pattern display system according to the present invention. In FIG. 1, numeral 1 designates a micro processing unit (hereinbelow, abbreviated to "MPU"), and numerals 2 and 3 designate bus lines for the addresses and data thereof, respectively. Numeral 4 indicates a display timing signal generator for display read, numeral 5 a display address signal line, and numeral 6 a display cycle signal line for switching the display read and MPU access. Numeral 7 indicates an address switch circuit, and numeral 8 a switched address signal line therefor. Shown at numeral 9 is an address select circuit. Display memories 12 are composed of four planes 12*r*, 12*g*, 12*b* and 12*z*. Shown at numeral 13 is a color data register. Numerals 10 and 11 denote selected signal lines for the display memories 12 and the color data register 13, respectively. Numeral 14 denotes a signal line for the output data of the color data register 13, numeral 15 a pattern data select and control circuit, and symbols 16*r*, 16*g*, 16*b* and 16*z* signal lines for data to be written into the display memories 12*r*, 12*g*, 12*b* and 12*z* and for data read out from these display memories, respectively. Symbols 17*r*, 17*g*, 17*b* and 17*z* denote parallel/serial converters which hold the read-out data from the display memories and convert them into serial data (signal lines 18*r*, 18*g*, 18*b* and 18*z*), respectively. Shown at numeral 19 is a rewritable memory whose address inputs are the serial data and which is called a "color look up table". Numeral 21 indicates a D/A converter by which output data (signal line 20) from the color look up table 19 are converted into analog RGB three-primary-color signals (signal line 22), and numeral 23 a color CRT display unit.

Figure 2:
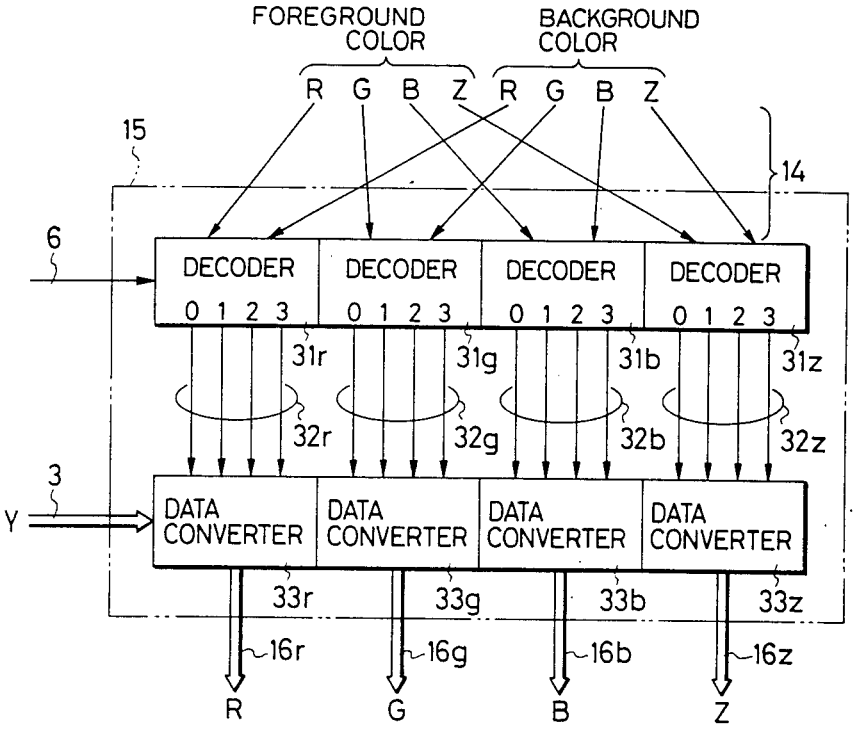
FIG. 2 is a detailed block diagram of a pattern data select and control circuit in FIG. 1.

FIG. 2 is a detailed diagram of the pattern data select and control circuit 15 in FIG. 1. Symbols 31*r*, 31*g*, 31*b* and 31*z* denote decode circuits, symbols 32*r*, 32*g*, 32*b* and 32*z* decoded output signal lines for the corresponding decode circuits, and symbols 33*r*, 33*g*, 33*b* and 33*z* data conversion circuits, and these constituents are disposed in numbers of four respectively.

Now, the operation of the character and pattern display system shown in FIGS. 1 and 2 will be described. The display memories 12 in FIG. 1 are composed of the four planes 12*r*, 12*g*, 12*b* and 12*z* which store data R, G and B representative of red, green and blue and data Z indicative of either a top intensity or a half intensity, respectively. They store character and pattern data for each of picture elements which consist of 256 dots in a lateral direction and 192 lines in a vertical direction as illustrated in FIG. 4A.

Figure 4A:
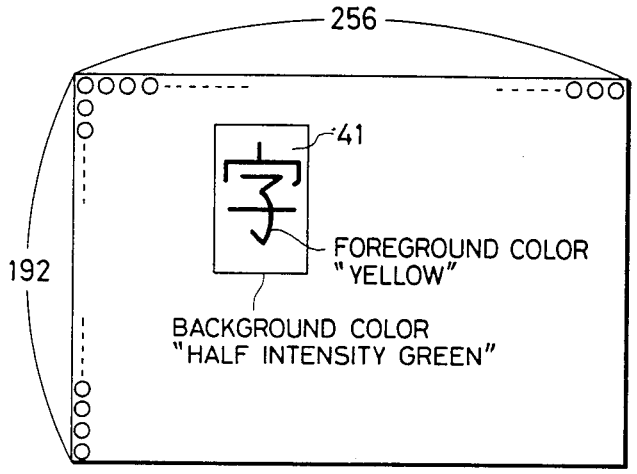
FIGS. 4A and 4B are diagrams showing an example of display of a character pattern and an example of data written in display memories, respectively.

As an example of the character and pattern data, there will be explained a case, as indicated in FIG. 4A, the character pattern of a Chinese character 41 is displayed with its foreground color being "yellow" and its background color being "half intensity green". In a character and pattern data system such as videotex, color data including a foreground color and a background color and also pattern data (in case of code transmission, pattern data from a character pattern ROM) are usually transmitted as in this exmaple. The MPU 1 disposed in a terminal for transmitting and receiving such data records the foreground color of "yellow" and the background color of "half intensity green" into the color data register 13 beforehand, and subsequently performs the process of writing the pattern data of the Chinese character 41 into the display memories 12.

Figure 3:
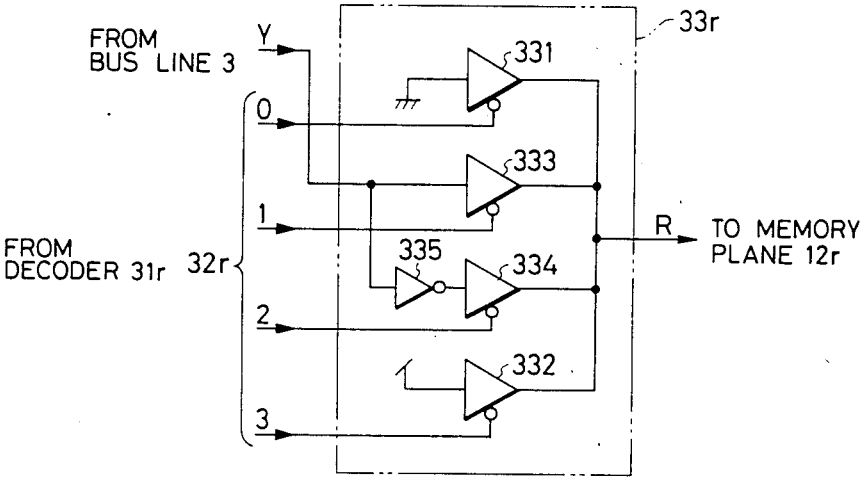
FIG. 3 is a block diagram showing an example of a data conversion circuit in FIG. 2.

The color output data (signal line 14) recorded in the color data register 13 is input to the pattern data select and control circuit 15, in which the pattern data on the data bus 3 of the MPU 1 is selected and controlled depending upon the combination of the color data of the foreground color and the background color and is converted into data to be written into the respective color data planes of the display memories 12. The pattern data select and control circuit 15 has a circuit arrangement shown in FIG. 2, which is composed of the four decode circuits 31*r*, 31*g*, 31*b* and 31*z* each decoding the 2 bits of the combination in bit unit between the color data of the foreground color and the background color, and the data conversion circuits 33*r*, 33*g*, 33*b* and 33*z* each producing the data to be written into the memory of the plane on the basis of the corresponding output signal 32*r*, 32*g*, 32*b* and 32*z*. The four decode circuits 31*r*, 31*g*, 31*b* and 31*z* decode the corresponding ones of the four 2-bit combinations between the output signals of the foreground color and the background color, each consisting of 4 bits, from the color data register 13, and they operate during a display read cycle in accordance with the cycle signal 6 for switching the display read and the MPU access. The data conversion circuits 33*r*, 33*g*, 33*b* and 33*z* convert a pattern data signal (indicated by Y) on the data bus 3 of the MPU 1 into the corresponding ones of the four groups of data R, G, B and Z to be written into the corresponding planes of the display memories 12, in accordance with the respective output signals 32*r*, 32*g*, 32*b* and 32*z* of the decode circuits. FIG. 3 shows the practicable circuit arrangement of each of the data conversion circuits 33*r*, 33*g*, 33*b* and 33*z*, and exemplifies the circuit 33*r* which converts the pattern data on the data bus 3 into the data to be written into the display memory 12*r* of the red data R. This circuit is composed of four controlled buffers and one inverter. The controlled buffers 331 and 332 have an output of low level "0" and an output of high level "1" at all times, respectively. The controlled buffer 333 delivers the input signal Y as it is. The controlled buffer 334 furnished with the inverter 335 at its input end delivers the inverted signal $\overline{Y}$ of the signal Y. The control terminals of these buffers are respectively connected to the decode output terminals 0, 1, 2 and 3 of the decode circuit 31*r*, and one of the terminals 0, 1, 2 and 3 becomes the high level "1" in accordance with the decoded result of the decode circuit 31*r*. The output of the buffer whose control terminal has been supplied with "1" becomes the output signal R of the data conversion circuit 33*r*.

This circuit 33*r* operates as follows. When the decode output 32*r* of the decode circuit 31*r* is "0", the write data bits become "0"; when the former is "1", the latter becomes the data on the data bus as it is; when the former is "2", the latter becomes the inverted value of the data on the data bus; and when the former is "3", the latter becomes "1".

Table 1 lists the data to-be-written which is delivered from the data conversion circuit 33*r* in FIG. 3 by converting the pattern data Y on the data bus 3, in correspondence with the decode output signals of the decode circuit 31*r* as well as the 2-bit combinations of the foreground color (FGC) and the background color (BGC) recorded in the color data register 13.

The other data conversion circuits 33*g*, 33*b* and 33*z* are the same in arrangement as the circuit 33*r* shown in FIG. 3, and operate similarly thereto.

TABLE 1

| Combination between Foreground Color (FGC) and Background Color (BGC) | | Output Signal of Decode | Data Bits to-be-Written obtained by Converting Pattern Data Y (00110110) (Output Signal of Data |
|---|---|---|---|
| BGC | FGC | Circuit 31r | Conversion Circuit 33r) |
| 0 | 0 | 0 | 00000000 |
| 0 | 1 | 1 | 00110110 (= Y) |
| 1 | 0 | 2 | 11001001 (= $\overline{Y}$) |
| 1 | 1 | 3 | 11111111 |

Figure 4B:
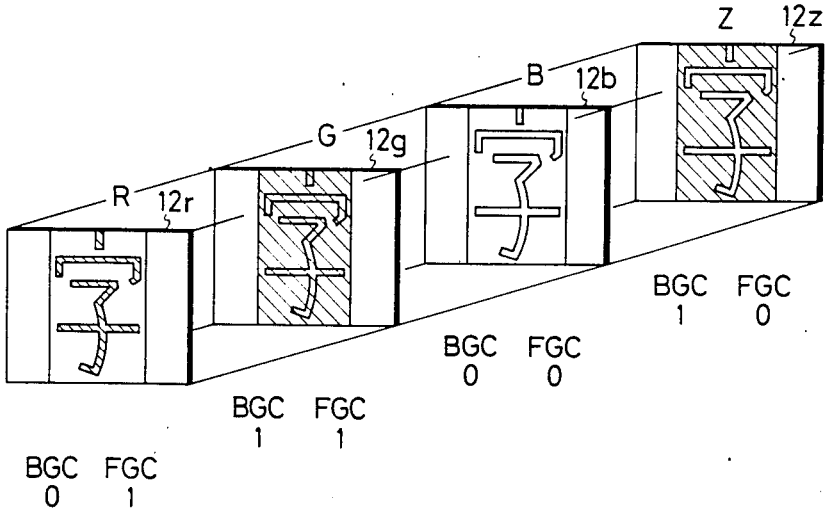

As regards the example shown in FIG. 4A, since the foreground color is "yellow" and the background color is "green", the pattern data left intact is written into the display memory 12*r* of the red (R) plane, data with its all bits being "1" is written into the display memory 12*g* of the green (G) plane, data with its all bits being "0" is written into the display memory 12*b* of the green (G) plane, and the inverted data of the pattern data is written into the display memory 12*z* of the "Z" plane, as illustrated in FIG. 4B.

The character pattern data in plane unit organization written into the display memories 12 in this manner is read out in accordance with the display address (signal line 5) from the display timing signal generator 4 and is converted into the picture signals of the three primary colors R, G and B via the parallel/serial conversion circuits 17*r*, 17*g*, 17*b* and 17*z*, color look up table 19 and D/A conversion circuit 21. Then, the color CRT display unit 23 can display the Chinese character pattern with the foreground color designated "yellow" and the background color desiganated "green".

As thus far described, according to the embodiment of the present invention, even in the display memories of the arrangement of the planes expressive of, for example, red, green and blue unlike the display memories of the arrangement composed of the pattern data memory and the color data memory, character and pattern data having foreground colors and background colors designated can be simultaneously converted into data to be written into the display memories of the respective planes, merely by the setting of the color data in the register and the processing of writing the pattern data into the display memories, so that enhancement in the speed of the writing into the display memories can be realized.

While the embodiment of the present invention has referred to the case of including the display memories composed of the four planes R, G, B and Z, the effects of the present invention do not concern the kinds or number of the planes of the display memories.

As set forth above, according to the present invention, in a character and pattern display system having display memories in a plane arrangement, character and pattern data with foreground colors and background colors designated are converted into data to be written into the display memories of respective planes and are written into them merely by the setting of color data in a register and the processing of writing pattern data. This brings forth the effect that the display processing of the character and pattern data is raised in speed, and the effect that the burden of software development can be relieved.

In addition, the present invention produces the effect that a character and pattern display circuit for a personal computer and a character and pattern display circuit for a videotex terminal can be made common, so the expansion of functions to other character and pattern display systems can be flexibly coped with.

I claim:

1. A character and pattern display system, comprising:

a plurality of display memories for storing color data for characters and patterns to be displayed;

display memory reading means for reading out character and pattern data stored in the display memories;

picture signal conversion means to convert the read-out data into picture signals;

means for supplying pattern data of characters and patterns to be displayed;

color data storing means for storing first color data designating a foreground color and second color data designating a background color of characters and patterns to be displayed, each of said first and second color data including a plurality of color signals;

a plurality of decode circuits, each connected to receive a color signal from each of said first and second color data, for generating control signals corresponding to the color data to be stored in said display memories; and a plurality of pattern data conversion circuits responsive to the control signals from respective decode circuits for converting said pattern data of the characters and patterns to be displayed into color data and for writing the color data into respective display memories.

2. A character and pattern display system according to claim 1, wherein said plurality of display memories are composed of a plurality of memory planes which store data representing the different colors, respectively, of the characters and patterns to be displayed and a single memory plane which stores data representing either of a top intensity or a half intensity of the characters and patterns to be displayed.

3. A character and pattern display system according to claim 2, wherein said plurality of memory planes representing the different colors are memory planes which represent red, green and blue, respectively.

4. A character and pattern display system, according to claim 3, wherein said first and second color data comprises red, green and blue color signals and an intensity signal, and each of said plurality of decode circuits is connected to receive a corresponding pair of color signals or intensity signals from said first and second color data, respectively, and includes means for generating control signals indicative of the states of the received pair of signals.

5. A character and pattern display system according to claim 1, wherein each of said plurality of pattern data conversion circuits comprises:

a first controlled buffer whose output is at a low level at all times;

a second controlled buffer whose output is at a high level at all times;

a third controlled buffer which delivers a received pattern data as it is; and a fourth controlled buffer which delivers an inverted data of the received pattern data;

said first through fourth controlled buffers being controlled by said control signals so that the output of any of said controlled buffers may be selected and delivered in response to the control signal delivered from the corresponding decode circuit.

6. A character and pattern display system according to claim 4, wherein each of said plurality of pattern data conversion circuits comprises:

a first controlled buffer whose output is at a low level at all times;

a second controlled buffer whose output is at a high level at all times;

a third controlled buffer which delivers a received pattern data as it is; and a fourth controlled buffer which delivers an inverted data of the received pattern data;

said first through fourth controlled buffers being controlled by said control signals so that the output of any of said controlled buffers may be selected and delivered in response to a respective control signal delivered from the corresponding decode circuit.

* * * * *